US005320682A

United States Patent [19]

Good et al.

[11] Patent Number: 5,320,682

[45] Date of Patent: Jun. 14, 1994

[54] METHOD FOR CLEANING PAINT RESIDUE FROM WALLS OF A PAINT BOOTH

[75] Inventors: Ross G. Good, South Lyon, Mich.; Donald E. Kaneski, High Ridge; David R. Powell, Kirkwood, both of Mo.

[73] Assignee: Chrysler Corporation, Highland Park, Mich.

[21] Appl. No.: 925,833

[22] Filed: Aug. 7, 1992

[51] Int. Cl.[5] ..... B08B 3/00; B08B 7/00; B08B 9/093

[52] U.S. Cl. ..... 134/38; 134/22.18; 134/34

[58] Field of Search ..... 134/22.18, 34, 38

[56] References Cited

U.S. PATENT DOCUMENTS

| | | | |
|---|---|---|---|
| 2,284,142 | 5/1942 | Gray | 134/38 |
| 3,846,172 | 11/1974 | Fossati | 134/38 |
| 3,985,922 | 10/1976 | Thornton et al. | 134/138 |
| 4,185,970 | 1/1980 | Dean | 134/38 |
| 4,231,804 | 11/1980 | Petterson et al. | 134/38 |
| 4,857,113 | 8/1989 | Hodge | 134/34 |
| 5,052,756 | 10/1991 | Wada et al. | 134/34 |

*Primary Examiner*—Dale R. Ore
*Attorney, Agent, or Firm*—Beverly M. Bunting

[57] ABSTRACT

A method is provided for cleaning paint residue from the walls of an enclosed chamber and providing for reclamation of the cleaning solution. The method includes providing a regulated flow of cleaning solution under pressure to a hand held scrubbing apparatus for removing paint residue from the wall surface. The cleaning solution with the paint residue entrained therein drips down the walls and is collected in a series of troughs lining the perimeter of the paint booth. Taking advantage of gravity, the liquid drains from the troughs into a temporary storage container located below the paint booth. The liquid may then be pumped into a permanent storage container that could be in a remote location. The liquid is now available for reclamation.

4 Claims, 3 Drawing Sheets

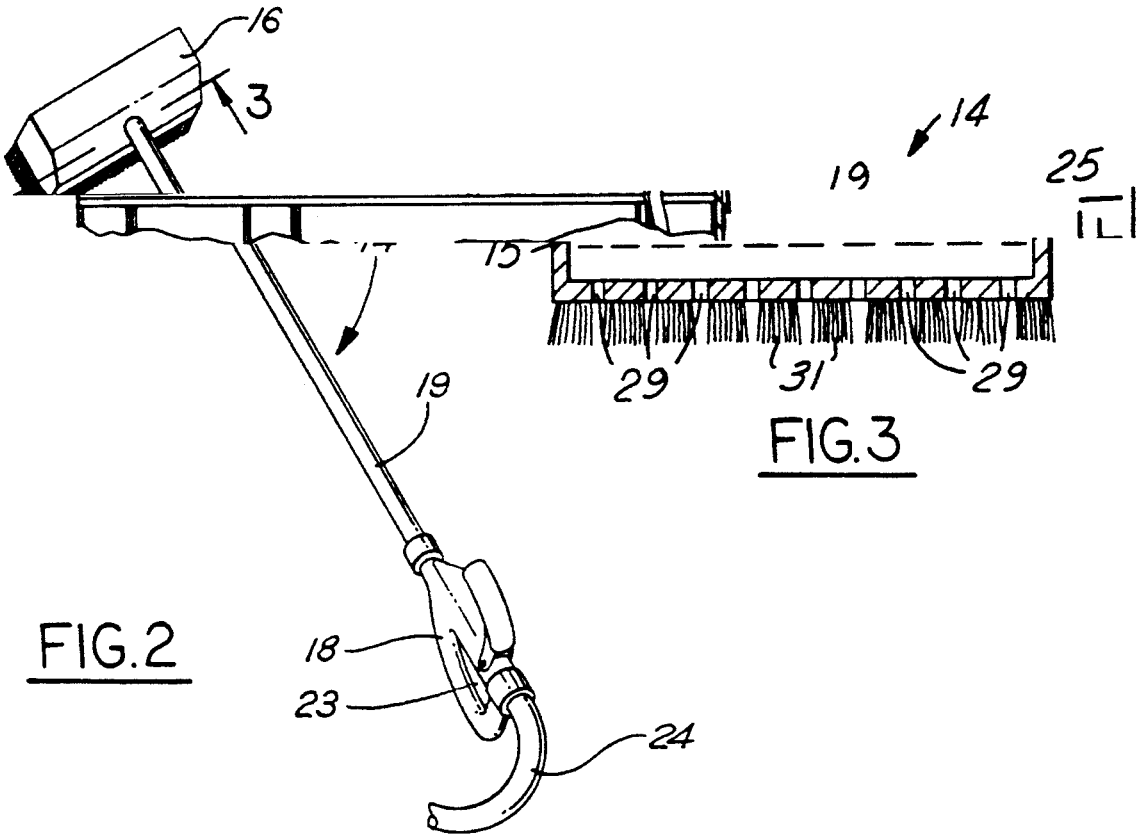
FIG.3
FIG.2
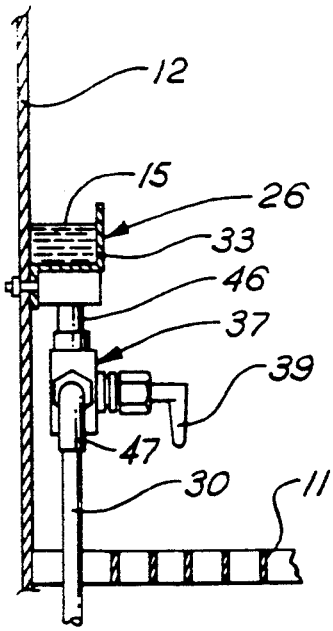
FIG.4

METHOD FOR CLEANING PAINT RESIDUE FROM WALLS OF A PAINT BOOTH

BACKGROUND OF THE INVENTION

1. Field of the Invention

The present invention relates to a method for cleaning paint residue from the walls of an enclosed chamber and providing for reclamation of the cleaning solution.

2. Description of The Related Art

Vehicle manufacturers are continuously striving to improve the process by which motor vehicles are assembled, in order to improve quality of the final product and at the same time reduce manufacturing costs. For instance, the typical method for painting a vehicle involves placing the vehicle in an enclosed chamber, typically called a paint booth, and spray painting the surface of the vehicle. As much as 40% of the paint used ends up as waste due to overspray, resulting in an accumulation of paint residue on the wall surfaces of the paint booth. A characteristic of paint commonly used on motor vehicles is that heat must be applied to cure the paint. As a result, the paint residue that collects on the walls of the paint booth typically is tacky. Periodic removal of the paint residue is necessary to prevent the buildup of paint, which tends to attract dirt that could become imbedded in the surface of the freshly painted vehicle.

In the past, removal of paint residue from the wall surfaces of the paint booth had been accomplished by filling a container with cleaning solution, dipping a scrub brush into the container and proceeding to wash the walls. This method is time consuming, and cleaning solution is wasted because it tends to drip from the scrub brush before use and also due to lack of a means for recovering the used cleaning solution.

SUMMARY OF THE INVENTION

An object of the invention is to decrease the amount of cleaning solution used in cleaning paint residue from a wall surface of an enclosed chamber.

Another object is to collect the used cleaning solution for reclamation.

The preferred embodiment of the subject method achieves the desired objects by first providing a source, such as a reservoir, for holding a quantity of liquid cleaning solution. An operator controls a regulated amount of cleaning solution flowing from the reservoir, through a hose, and out of a hand held scrubbing apparatus. The operator may then apply the cleaning solution to the wall surface, while scrubbing the wall, and the cleaning solution, now containing paint residue, is allowed to drip down the wall surface. The cleaning solution is collected in a trough that lines the perimeter of the wall surface.

The operator controls a three way valve that directs the flow of fluid that has accumulated in the trough, which may be water or cleaning solution, into a floor grate or to an intermediate recovery reservoir. Gravitational forces are relied upon to transport the cleaning solution from the trough into an intermediate recovery reservoir located at a lower level than the chamber. The cleaning solution can than be pumped to a remote location where it may be stored until reclaimed.

One advantage of the subject invention is that the amount of time required to maintain a paint booth is reduced. Another advantage is that the used cleaning solution can be reclaimed for subsequent use.

Other objects, feature and advantages of the present invention will become more fully apparent from the following Description of the Preferred Embodiment, the claims and the accompanying drawings.

BRIEF DESCRIPTION OF THE DRAWINGS

FIG. 2 is a perspective view of a hand held scrubbing apparatus;

FIG. 3 is a sectional view of a scrub brush taken substantially along line 3—3 of FIG. 2, looking in the direction of the arrows;

FIG. 4 is a sectional view taken substantially along line 4—4 of FIG. 1 looking in the direction of the arrows showing a wall panel, trough and three way valve to substantially show how the cleaning solution is collected and drained.

DESCRIPTION OF THE PREFERRED EMBODIMENT

Figure 1:
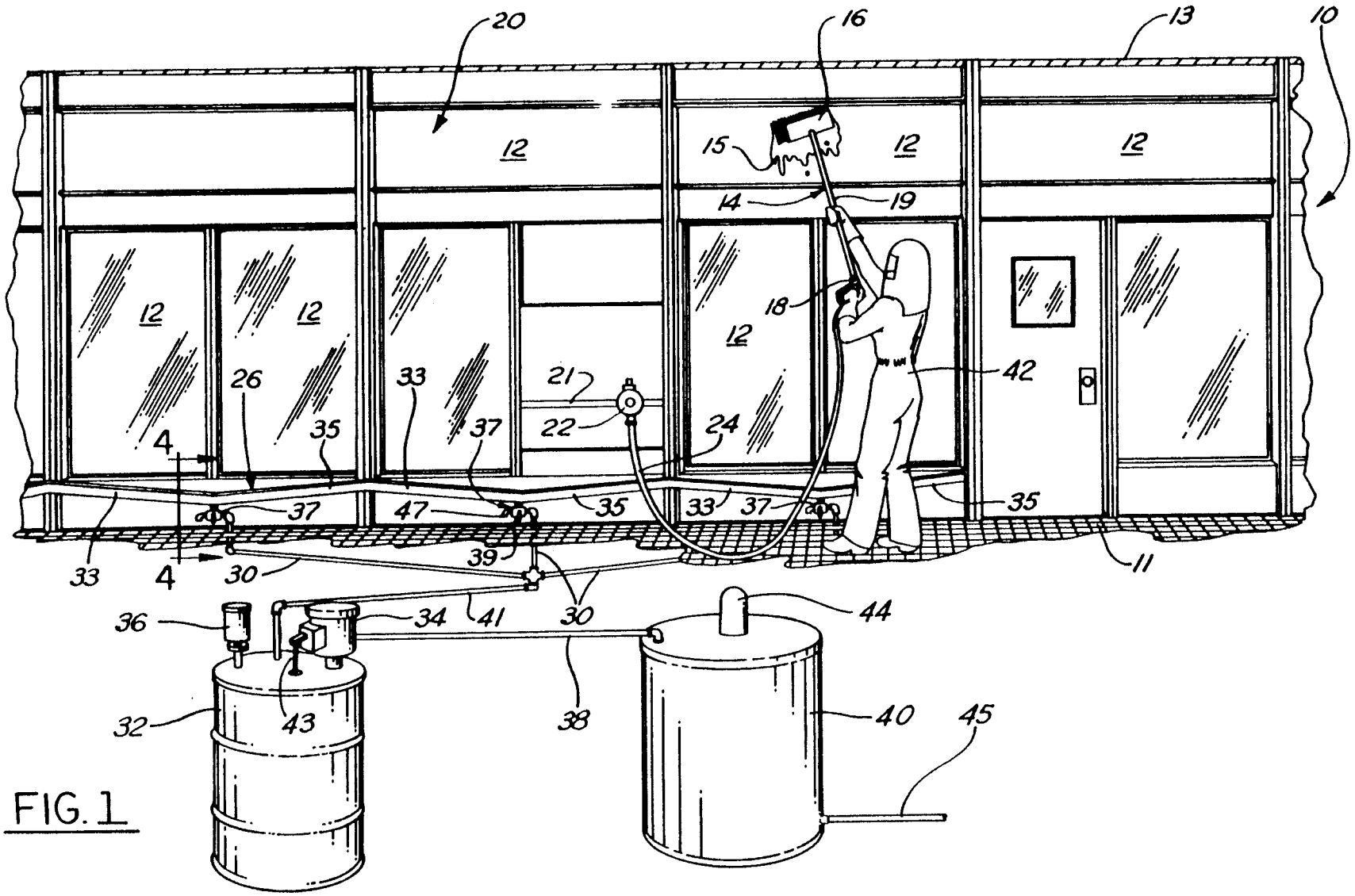
FIG. 1 is an elevational view of an enclosed chamber and related cleaning apparatus.

Referring to FIG. 1, an enclosed chamber 10 is shown, of the type primarily used to paint motor vehicle bodies as part of the manufacturing process. The chamber 10 includes a floor 11 that is composed of a grate, oppositely disposed side wall surface 20 formed by a plurality of panels 12, one side wall surface only shown, and a ceiling 13. Periodic maintenance of the chamber 10 by an operator 42 is required to remove accumulated paint residue due to overspray from the painting operation from wall surface 20.

A reservoir (not shown) for holding a liquid cleaning solution 15 used in removing paint residue from the wall surface 20 is located outside chamber 10. Pressurized cleaning solution 15 is delivered to enclosed chamber 10 via conduit 21. It should be appreciated that cleaning solution 15 may be a solvent capable of dissolving paint, such as xylol, di-isobutyl ketone, or methyl ethyl ketone.

A fluid regulator 22 capable of controlling the volume and pressure of liquid passing therethrough is secured to conduit 21, allowing for a regulated rate of flow of cleaning solution 15. A hose 24 is disposed between the regulator 22 at one end and a hand held scrubbing apparatus 14 at the second end to facilitate the flow of cleaning solution 15 through the hose 24 and scrubbing apparatus 14 and onto wall surface 20.

The operator 42 utilizes the scrubbing apparatus 14 to remove the accumulated paint residue from wall surface 20. The cleaning solution 15 with paint residue entrained therein is allowed to drip down wall surface 20.

Located adjacent the lower end of the wall surface 20 is a trough 26 running along the length of enclosed chamber 10 for collecting and draining of cleaning solution 15. The trough 26 comprises alternate sections of downwardly angled sections 33, 35 for gravity flow of cleaning solution 15. Water may also be collected as a condensate during normal use of chamber 10 for painting, and accumulate in the trough 26. The trough 26 has a drain 46 at the lower juncture of each pair of sections 33, 35 to facilitate removal of the cleaning solution 15 containing the paint residue entrained therein or water that has collected in the trough 26.

Drainage of the fluid collected in the trough 26 is controlled by a 3-way valve 37 connected at one end to the drain 46 in the trough 26, at a second end to a recovery line 30, and an outlet 47 at a third end. It is not desired to have water mixed with the cleaning solution 15. The 3-Way valve 37 has an actuating handle 39 which allows the operator 42 to divert the flow of water onto the grated floor 11 via outlet 42 or the cleaning solution 15 having paint residue entrained therein into recovery line 30.

An intermediate recovery reservoir 32, such as a drum, is located at a lower level than the chamber 10, but adjacent thereto to permit gravity drainage of cleaning solution 15 with paint residue entrained therein to intermediate recovery reservoir 32 via main recovery line 41, which is connected to recovery line 30.

The intermediate recovery reservoir 32 has an agitator 36, such as a turbine tube mixer, suitable for maintaining the paint residue entrained in the cleaning solution 15. The intermediate recovery reservoir 32 has a pump 34, such as an explosion-proof sump pump for use with flammable and combustible liquids, to pump the cleaning solution 15 from intermediate recovery reservoir 32 through a recovery line 38 connected between intermediate recovery reservoir 32 and a main recovery reservoir 40. The pump 34 has a float device 43 to control operation thereof.

The main recovery reservoir 40 is positioned in any convenient location. However it is preferably placed in a remote location, thus saving space in the manufacturing area. The main recovery reservoir 40 also has an agitator 44 to maintain the liquid therein in a well-mixed state. Main recovery reservoir 40 is periodically emptied via outlet 45 for reclamation of the liquid contained therein.

Referring to FIG. 2, a hand held scrubbing apparatus 14 is shown having a handle 18 connected to one end of a hollow tube 19, and at a second end to the hose 24. A second end of the tube 19 is connected to a scrub brush 16, which is used to remove the paint residue from the wall surface 20. Details of the scrub brush 16 are shown in FIG. 3. It should be appreciated that the handle 18, tube 19 and scrub brush 16 are formed from non-sparking materials such as brass, or plastic.

Handle 18 includes an on-off valve (not shown) controlled by a trigger 23 for starting or stopping the flow of cleaning solution 15. The trigger 23 is preferably spring actuated, so that flow will automatically cease when operator 42 releases it. This prevents wasting cleaning solution 15 at times when the operator 42 is not scrubbing.

Referring to FIG. 3, to dispense cleaning solution 15, scrub brush 16 includes a hollow base 11 having a plurality of outlet apertures 29, with a plurality of bristles 31 extending from the section of the base 25 containing the apertures 29 to feed cleaning solution 15 to the bristles 31 and facilitate removal of paint residue.

FIG. 4 is a sectional view illustrating how gravity is advantageously used to collect the cleaning solution 15 dripping down a panel 12, accumulating in a trough 16, and then draining the cleaning solution 15 into the intermediate recovery reservoir 32.

Figure 5:
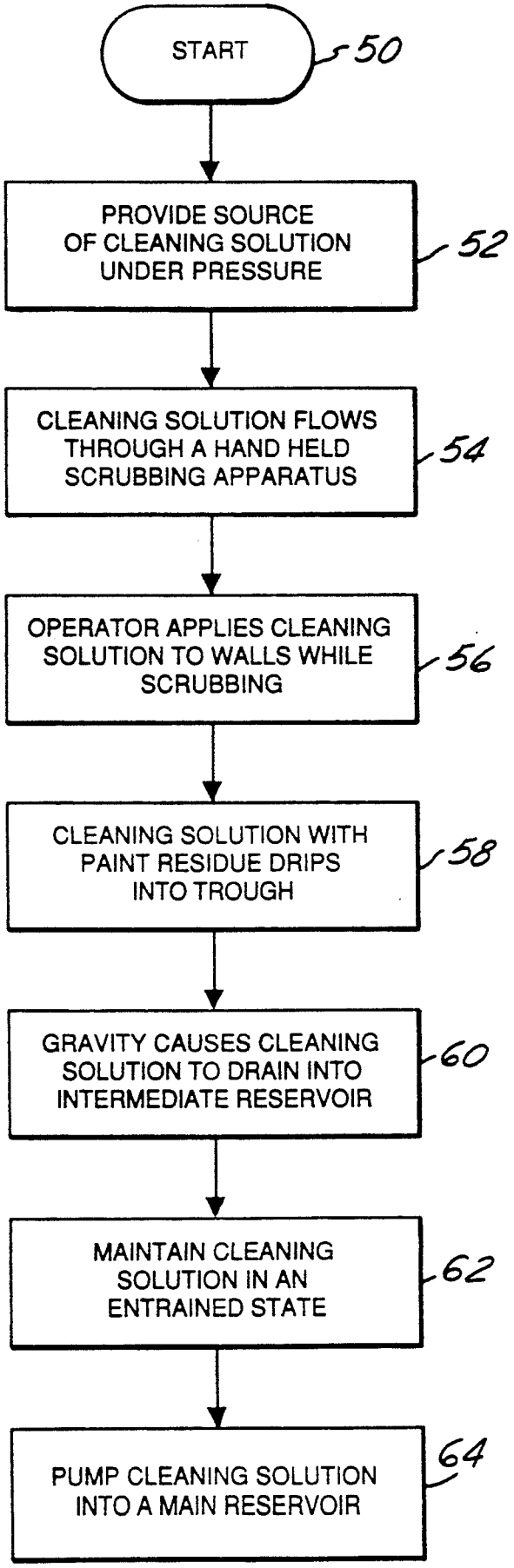
FIG. 5 is a block diagram of the method for cleaning paint residue from a wall surface of the enclosed chamber.

Referring to FIG. 5, A method for cleaning paint residue from a wall surface of an enclosed chamber, such as a paint booth, using a liquid cleaning solution and providing for the reclamation of the cleaning solution is shown.

The method begins in block 50 and continues to block 52. In block 52, a source of a liquid cleaning solution 15 under pressure is provided. Continuing to block 51, a regulated rate of flow of the cleaning solution 15 passes through a hose 24 and into a hand held scrubbing apparatus 14. In block 56 the operator 42 applies cleaning solution 15 to a wall surface 20 while simultaneously scrubbing with the scrub brush 16 end of the scrubbing apparatus 14. In block 18, cleaning solution 15 having the paint residue entrained therein drips down wall surface 20 into the trough 26 adjacent to wall surface 20.

In block 60, relying on gravitational forces, the cleaning solution 15 having paint residue entrained therein drains into an intermediate recovery reservoir 32. In Block 62, a device such as agitator 36 is used to maintain the cleaning solution 15 in an entrained state. In Block 64, the cleaning solution is pumped from the intermediate recovery reservoir 32 to a main recovery reservoir 40, where a agitator 41 maintains the cleaning solution 15 in an entrained state.

We claim:

1. A method of cleaning paint residue from a wall surface of an enclosed chamber for applying paint to an object using a liquid cleaning solution, and providing for recovery of:

a. providing a source of a liquid cleaning solution under pressure;

b. regulating a rate of flow of the cleaning solution through a hand held scrubbing apparatus;

c. applying said cleaning solution to a wall surface of said chamber while scrubbing with said scrubbing apparatus;

d. collecting liquid having paint residue entrained therein as it drains from said wall surface into troughs provided along said wall surface and located adjacent to a lower end of said wall surface;

e. gravity draining said liquid from said troughs to an intermediate recovery reservoir located at a lower level than said chamber;

f. agitating said liquid contained within said intermediate recovery reservoir to maintain the paint residue in an entrained state;

g. pumping said liquid from the intermediate recovery reservoir to a main recovery reservoir; and h. agitating said liquid contained within said main recovery reservoir to maintain the paint residue in an entrained state.

2. The method of cleaning a chamber as recited in claim 1, wherein said main recovery reservoir is remote from said intermediate recovery reservoir.

3. The method of cleaning a chamber as recited in claim 1, further comprising the steps of:

a. blocking flow of fluid present in said trough as a consequence of normal use of the chamber from flowing into said intermediate recovery reservoir; and b. continuously draining any such fluid present in said trough to a collecting point other than said intermediate trough prior to starting the flow of said cleaning solution.

4. The method of cleaning a chamber as recited in claim 1, wherein the step of regulating the rate of flow of cleaning solution through the scrubbing apparatus is accomplished by:

a. providing a scrubbing apparatus including an elongated tubular member having a scrub brush with a hollow interior affixed at a first end thereof;

b. a plurality of openings communicating with the hollow interior of the scrub brush for dispensing the clean solution through;

c. providing a handle having a trigger for controlling the flow of cleaning solution fixed at a second end of the elongated tubular member; and d. connecting said handle to the source of cleaning solution by means of a flexible hose attached at one end to said handle and at an other end to said source of cleaning solution.

* * * * *